United States Patent [19]

Gifford, Jr.

[11] 4,444,109

[45] Apr. 24, 1984

[54] FLAME ARRESTOR DEVICE WITH POUROUS MEMBRANE

[75] Inventor: Lincoln S. Gifford, Jr., Lake Katrine, N.Y.

[73] Assignee: Hercules Incorporated, Wilmington, Del.

[21] Appl. No.: 443,343

[22] Filed: Nov. 19, 1982

[51] Int. Cl.[3] ..... F42D 5/00; F17D 3/00

[52] U.S. Cl. ..... 102/200; 48/192; 55/DIG. 20; 431/346

[58] Field of Search ..... 48/192; 55/DIG. 20, 55/523, 385 R; 60/39.11; 102/301, 316, 200; 431/346; 220/88 R, 88 A

[56] References Cited

U.S. PATENT DOCUMENTS 3,031,285 4/1962 Hedberg ..... 48/192
3,288,578 11/1966 Witt ..... 48/192
4,073,235 2/1978 Hopler, Jr. ..... 102/200

FOREIGN PATENT DOCUMENTS 1490993 11/1977 United Kingdom ..... 431/346

*Primary Examiner*—S. Leon Bashore, Jr.
*Assistant Examiner*—K. M. Hastings
*Attorney, Agent, or Firm*—John E. Crowe

[57] ABSTRACT

A flame arrestor device capable of checking flashback when incorporated in a system utilizing one or more detonatable gases under pressure for controlled energy release purposes, the device being generally installed in series having one or more gas sources upstream while gas conducting means and ignition means are arranged downstream of a membrane barrier mounted and secured to a supporting means which is, in turn, mounted within an arrestor housing with provision for gaps of limited size on the upstream and downstream side of the membrane barrier to permit gas flow. The invention includes built in or separate ignition means downstream of the membrane barrier.

22 Claims, 3 Drawing Figures

FLAME ARRESTOR DEVICE WITH POUROUS MEMBRANE

BACKGROUND OF THE INVENTION

1. Field of Use

This invention relates to a flame arrestor device capable of checking upstream flashback while permitting downstream charging through said assembly to a connection system with detonatable or potentially detonatable gas. The device and systems utilizing this device are not as vulnerable to flashback problems while still retaining the flexibility and safety of a chemical as opposed to other activating means, particularly as applied to explosives detonation as well as gas flame cutting or similar systems dependent upon controlled release of chemical energy.

2. Prior Art

Flame arrestor devices to which this invention pertains are known and serve the purpose of halting flame in a flow passage containing combustible, but not necessarily detonatable, gas mixtures. These prior art flame arrestors are generally adapted to function efficiently and safely only at relatively low pressures.

OBJECT OF THE INVENTION

It is an object of this invention to provide an efficient flame arrestor device capable of halting upstream flashback in systems utilizing fuel and oxidizer gases under substantial positive pressure.

It is a further object of this invention to provide a flame arrestor device that is durable and adapted for repeated usage in various systems utilizing detonatable or potentially detonatable gases.

It is a still further object of this invention to provide a combined arrestor ignition device capable of being safely and repeatedly used for chemical explosives detonation purposes using detonatable gas mixtures and ignition means as activators thereof.

These and other objects of this invention have been accomplished and are more fully characterized in the following disclosure.

SUMMARY OF THE INVENTION

The present invention relates to a system and flame arrestor device utilized therein for checking upstream flashback of detonatable or potentially detonatable gas held under pressure, the arrestor device described comprising an arrestor housing having an upstream entry port opening to an interior housing well, a downstream exit port and housing gas flow passage interconnecting the exit port and the housing well.

A membrane holding means is positioned within the entry port and the interior housing well of the arrestor housing and endwise secured in gas-tight relation at the bottom upstream end of the arrestor housing. Such holding means conveniently has a varied outside diameter less than the corresponding inside diameter of the arrestor housing well so as to form a gas-tight seal at the upstream end and to define an interspace along the inside top and sides of the arrestor housing.

A gas-permeable flash resistant porous membrane is positioned and maintained within the confines of the above-defined interspace by spacing means and the membrane endwise secured in gas-tight relation to the membrane holding means, whereby the interspace is partitioned into first and second gaps, the first gap being positioned downstream of the membrane in isolation from the second gap except through gas-permeable pores in the membrane. Gas passing through such membrane is flowably connected to the downstream exit port of the arrestor housing by interconnecting housing gas flow passage. The second gap defined by the membrane holding means and the gas-permeable membrane, is positioned upstream of the membrane and flowably connected by interconnecting flow passage and flow passage entry conveniently passing through at least part of the membrane holding means to conveniently located gas feeding means upstream of said arrestor device, such as one or more pressure tanks.

The first and second gaps as described above expose sufficient amount of the permeable membrane and are of sufficient limited depth or cross section to permit passage of gas downstream through the porous membrane while retaining the integrity and strength of the membrane barrier to repeatedly check upstream directed flashback in systems carrying substantial preignition gas pressure.

A system using such device is conveniently activated by ignition means positioned downstream of the flash resistant gas-permeable membrane in contact with the gas without danger from upstream flashback by initially bleeding the gas under positive pressure downstream of the gas feeding means through the arrestor device by entry port, flow passage, second gap, gas-permeable membrane, first gap, housing flow passage and exit port to an attached hollow flow passage to a downstream site of utilization before energizing the ignition means.

Figure 1:
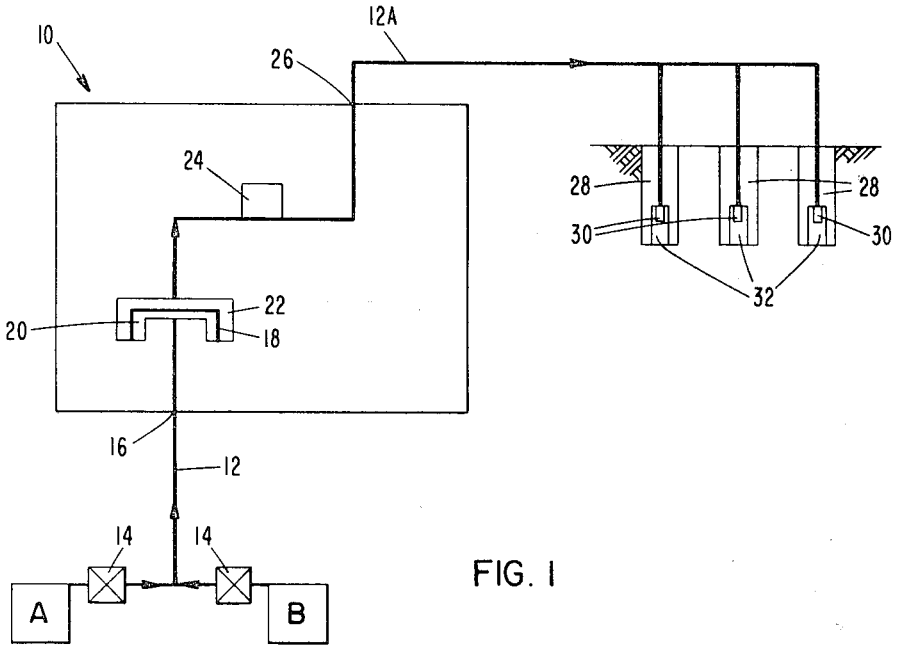
FIG. 1 schematically illustrates one embodiment of the present invention in which the flame arrestor device (10) is incorporated in series in an essentially chemically activated explosives detonator system utilizing ignition means (24) such as a spark plug incorporated within the housing of the device (10) in electrical firing contact with a detonatable gas mixture extending downstream of a porous metal membrane (18) through a downstream gap (22), exit port (26), and hollow flow passage (12A) to one or more remote blasting holes (28) containing non-electric blasting caps (30) secured to the hollow flow passage and main explosive charge (32).

The system described in FIG. 1 can be conveniently modified within the scope of the present invention by locating igniter means (24) downstream of exit port (26). With such modification the arrestor device can be used as a detonating system and also conveniently utilized in other pressurized gas systems having potential flash or blowback problems such as a gas-flame cutting torch in which the point of ignition and point of admixture with oxidant gas are traditionally located close to the cutting flame at a nozzle.

Figure 2:
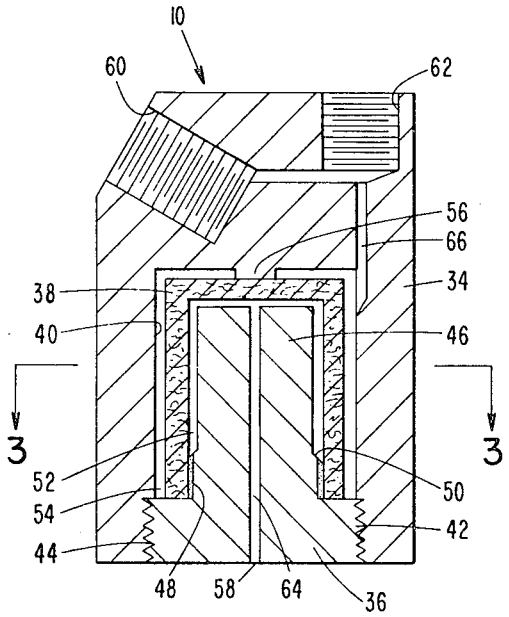

FIG. 2 is a longitudinal section of a flame arrestor of the general type represented schematically in FIG. 1.

Figure 3:
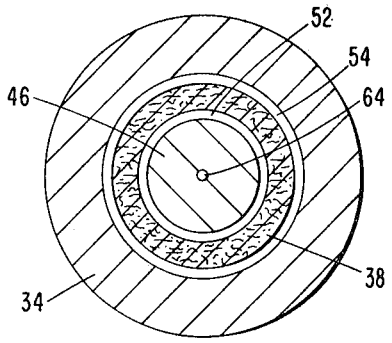

FIG. 3 is a cross section of flame arrestor (10) taken along line 3—3 of FIG. 2.

DETAILED DESCRIPTION OF PREFERRED EMBODIMENTS OF THE INVENTION

In further reference to FIG. 1, flame arrestor device (10) is used to check upstream flashback in an explosive detonation system utilizing a detonatable gas and ignition means. For such purpose the fuel and oxidant gases coveniently comprise a fuel such as hydrogen and an oxidant such as oxygen obtained from gas feeding means (A) and (B) through valving means (14) and interconnecting flow passage as above described.

The speed of a detonation or reaction wave through a hollow flow passage tube (12A) depends upon the choice and proportion of fuel and oxidizer in the detonatable or potentially detonatable gas mixture, and the preignition pressure maintained in the system. A reaction speed of about 8000 ft/sec, however, is found generally acceptable for controlled detonation purposes.

Preparation for detonation in the system of FIG. 1 usually includes an initial pressure testing for blockage with an inert gas from a source (not shown) followed by charging of the detonator by metering oxygen from tank (A) and fuel such as hydrogen and/or hydrocarbon mixture from tank (B) through valve (14), down flow passage (12) into entry port (16) in the flame arrestor device.

The flame arrestor device contains a gas-permeable flash resistant porous membrane (18), positioned between first and second gaps (22) and (20). The detonatable gas mixture passes through membrane (18) under pressure aided by the increased flow area around the membrane provided by gaps (20) and (22). The detonatable gaseous-mixture then proceeds past ignition means (24) and exits the arrestor device by exit port (26). After the detonatable gaseous mixture leaves the arrestor device it fills flow passage (12A) through connections (not shown) to trunklines leading to the desired number of remotely located blasting holes (28) to blasting caps (30) and the main explosive charges (32) as above described.

In further reference to FIG. 2 there is shown in greater detail a combined arrestor-ignition device (10) comprising arrestor housing (34) having an upstream entry port and interior housing well (40), a downstream exit port (60), a housing gas flow passage (66) flowably interconnecting exit port (60) and interior housing well (40), an ignitor housing (62) containing ignitor means (not shown) with an interior threaded port (not shown) opening to the housing gas flow passage for screwably mounting an ignitor means (such as a spark plug or equivalent sparking device) in contact with a detonatable gas mixture, and spacer means in the form of a standoff button (56).

The device further includes a membrane holding means (36) comprising a stem (46) and externally threaded flange (42) section, secured to entry port and interior housing well (40) in gas-tight relation at the bottom upstream end of the arrestor housing well and entry port to define an interspace along the inside top and sides of the arrestor housing.

A gas permeably flash resistant porous membrane (38) is positioned within the interspace and endwise secured in gas-tight relation (48) to the stem section (46) at lip (50) and conveniently maintained in position within the interspace by said lip and by stand off button (56), resulting in partition of the interspace into first and second gaps, the first gap (54) being positioned downstream of flash resistant membrane (38) in the form of a shaped sheet or cup, in isolation from the second gap (52) other than through gas-permeable pores in membrane (38), and flowably connected to the downstream exit port (60) of the arrestor housing by interconnecting housing gas flow passage (66).

The second gap (52) is positioned upstream of membrane (38) and flowably connected by interconnecting flow passage (64) and flow passage entry (58) through holding means (36) to conveniently located gas feeding means (not shown) upstream of the arrestor housing.

FIG. 3 in combination with FIG. 2 further demonstrates a convenient (although not mandatory) cylindrical shape of the housing (34) and membrane holder stem (46), and the preferred cup shape of porous membrane (38).

Generally speaking the mass and good conductivity of the flame arrestor housing and membrane holding means serves to protect them from the heat of flashbacks, thereby permitting the utilization of relatively low melting easily machined metals such as brass and copper, as well as the usual stainless and carbon steels. Such is not the case, however, with the porous membrane (38), particularly when comprised of fine particulate metal particles, (e.g. 3–5 micron), such as found in a micro filter. In such case the use of stainless steel or similar material is required to avoid heat damage. An example of such material is a stainless steel micro filter comprising a plurality of fine metal particles of the type manufactured by Mott Metallingical Company—under the identifying code 120-0.678-0.573-0.840-5, in which the melting point of the stainless steel particles is sufficiently high to compensate for small mass and relatively low heat conductivity.

As previously noted, the thickness of first and second gap (54) and (52) is of functional significance insofar as the heat and flashback resistance and general durability are not necessarily compatible with the gas-permeable properties of the membrane. It has been found, however, that individual gap depths of up to about 20 mil, preferably 5–20 mil, permit the necessary gas flow rate without adversely affecting the flame arrestor properties with a sintered stainless steel membrane having a pore size of about 2.5–25 microns, the smaller size being favored, commensurate with a desired flow rate, when high pre-ignition gas pressures are utilized.

What I claim and desire to protect by Letters Patent is:

1. A flame arrestor device for checking upstream flashback when incorporated in a system containing one or more detonatable or potentially detonatable gases under pressure, said arrestor comprising, in combination an arrestor housing having an upstream entry port opening to an interior housing well, a downstream exit port and housing gas flow passage interconnecting said exit port and said housing well;

membrane holding means positioned within the entry port and interior housing well of said arrestor housing and endwise secured in gas-tight relation at the bottom upstream end of the arrestor housing, said membrane holding means having an outside diameter less than the corresponding inside diameter of the arrestor housing well to form a gas-tight seal at the upstream end and to define an interspace along the inside top and sides of the arrestor housing;

a gas-permeable flash resistant porous membrane positioned and maintained within said interspace by spacing means, and endwise secured in gas-tight relation to the membrane holding means, whereby said interspace is partitioned into first and second gaps, said first gap being positioned downstream of said flash resistant membrane in isolation from said second gap except through gas-permeable pores in said membrane and flowably connected to said downstream exit port of the arrestor housing by said interconnecting housing gas flow passage, while said second gap defined by part of said membrane holding means and said gas-permeable membrane is positioned upstream of said flash resistant membrane and flowably connected by interconnecting flow passage and flow passage entry through the membrane holding means to conveniently located gas feeding means upstream of said arrestor device;

a hollow flow passasge for conducting gas downstream from said exit port to a site of utilization; and ignition means in contact with said gas at a point downstream of said gas-permeable flash resistant porous membrane;

whereby ignition flashback is checked from passing upstream of said membrane without preventing downstream bleeding of gas through the device under pressure.

2. A flame arrestor device of claim 1, wherein said membrane has the configuration of a shaped flash resistant sheet permeable to a fuel or fuel-oxidizing gas mixture.

3. A flame arrestor device of claim 2, wherein said shaped sheet is generally cup shaped, the lip of which is bonded to said membrane holding means.

4. A flame arrestor device of claim 2, wherein the depth of said first and second gap does not individually exceed about 20 mils.

5. A flame arrestor device of claim 2, wherein said membrane comprises a heat resistant metal permeable to a fuel and oxygen gas mixture and the individual depth of said first and second gap is individually within the range of about 5–20 mils.

6. A flame arrestor device of claim 4 wherein said membrane comprises gas-permeable sintered stainless steel.

7. A flame arrestor device of claim 2 wherein ignition means is incorporated within said arrestor device in firing contact with said gas downstream of said membrane.

8. A flame arrestor device of claim 4 wherein the gas-permeable flash resistant membrane is at least secured to the membrane holding means by adhesive bonding.

9. The device of claim 8 wherein adhesive bonding is an epoxy seal.

10. A combined flame arrestor and firing device for checking upstream flashback in an explosives detonation system activated by ignition means and a detonatable gas mixture under pressure, said device comprising, in combination an arrestor housing having an upstream entry port opening to an interior housing well, a downstream exit port, a housing gas flow passage flowably interconnecting said exit port and said interior housing well, an ignitor housing containing ignitor means and an interior threaded port opening to said housing gas flow passage for mounting said ignitor means in contact with said detonatable gas mixture;

membrane holding means positioned within the entry port and housing well of said arrestor housing and endwise secured in gas-tight relation at the bottom upstream end of the arrestor housing, said membrane holding means having an outside diameter less than the corresponding inside diameter of the arrestor housing well and entry port to define an interspace along the inside top and sides of the arrestor housing; and a gas-permeable flash resistant porous membrane positioned within said interspace and endwise secured in gas-tight relation to the membrane holding means whereby said interspace is partitioned into first and second gaps said first gap being positioned downstream of said flash resistant membrane in isolation from said second gap other than through gas-permeable pores in said membrane and flowably connected to said downstream exit port of the arrestor housing by said interconnecting housing gas flow passage, while said second gap is positioned upstream of said flash resistant membrane and flowably connected by interconnecting flow passage and flow passage entry through the membrane holding means to conveniently located gas feeding means upstream of said arrestor device;

whereby said explosive detonation system is safely activated for detonation by said ignition means without danger from upstream flashback.

11. A flame arrestor device of claim 10 wherein said membrane holding means comprises flange and stem sections, said flange section being generally cylindrical in shape and externally threaded for engaging the inner surface of said upstream entry port, and said stem section is of a smaller diameter than said flange to define said second gap in conjunction with said flash resistant porous membrane.

12. A flame arrestor device of claim 10, wherein said flash resistant membrane has the configuration of a shaped sheet permeable to a fuel-oxidizing gas mixture.

13. A flame arrestor device of claim 12, wherein said shaped sheet is generally cup shaped, the lip of which is bonded to an inside lip of said stem section of said membrane holding means.

14. A flame arrestor device of claim 11 wherein said housing has a standoff button and said membrane holding means has a lip to position and secure the membrane within said interspace and maintain said first and second gaps.

15. A flame arrestor device of claim 10, wherein the depth of said first and second gap does not individually exceed about 20 mils.

16. A flame arrestor device of claim 15, wherein said membrane comprises a heat resistant metal permeable to a fuel and oxygen gas mixture and the depth of said first and second gap is individually within the range of about 5–20 mils.

17. A flame arrestor device of claim 16 wherein said membrane comprises gas-permeable sintered stainless steel having a pore size of about 2.5–25 microns.

18. A flame arrestor device of claim 10 wherein said ignition means is a sparking device threaded into said igniter port in firing contact with said detonatable gas mixture downstream of said membrane.

19. A flame arrestor device of claim 10 wherein the gas-permeable flash resistant membrane is secured to the stem section of said membrane holding means by adhesive bonding.

20. The device of claim 19 wherein the adhesive bonding is an epoxy seal.

21. An explosive detonation system comprising, in combination gas feeding means for supplying a detonatable or potentially detonatable gas under pressure by one or more hollow flow passages to a detonator cap and main explosives charge; and a flame arrestor device as defined in claim 10 arranged in series with said hollow flow passages intermediate said gas feeding means and said detonator cap.

22. The system of claim 21 wherein said gas feeding means comprises valved pressure tanks.

* * * * *